US010745234B2

(12) United States Patent
Watanabe

(10) Patent No.: US 10,745,234 B2
(45) Date of Patent: Aug. 18, 2020

(54) SHEET PROCESSING APPARATUS, IMAGE FORMING SYSTEM, AND SHEET PROCESSING METHOD

(71) Applicant: CANON FINETECH NISCA INC., Misato-shi (JP)

(72) Inventor: Kiyoshi Watanabe, Matsudo (JP)

(73) Assignee: Canon Finetech Nisca Inc., Misato-shi (JP)

( * ) Notice: Subject to any disclaimer, the term of this patent is extended or adjusted under 35 U.S.C. 154(b) by 150 days.

(21) Appl. No.: 16/001,238

(22) Filed: Jun. 6, 2018

(65) Prior Publication Data

US 2018/0362274 A1 Dec. 20, 2018

(30) Foreign Application Priority Data

Jun. 16, 2017 (JP) ..... 2017-118765
May 8, 2018 (JP) ..... 2018-089823

(51) Int. Cl.
*B65H 37/06* (2006.01)
*B65H 9/00* (2006.01)

(52) U.S. Cl.
CPC ..... *B65H 37/06* (2013.01); *B65H 9/002* (2013.01); *B65H 2301/5122* (2013.01); *B65H 2301/5123* (2013.01); *B65H 2553/822* (2013.01)

(58) Field of Classification Search
CPC ..... B65H 45/12; B65H 45/30; B65H 2301/5122; B65H 37/06; B65H 45/109
See application file for complete search history.

(56) References Cited

U.S. PATENT DOCUMENTS

| | | | | |
|---|---|---|---|---|
| 7,815,179 | B2 * | 10/2010 | Taguchi | B26D 5/02 270/30.08 |
| 8,333,371 | B2 * | 12/2012 | Kikkawa | B65H 37/06 270/32 |
| 8,387,964 | B2 * | 3/2013 | Saito | B65H 45/18 270/32 |
| 8,413,974 | B2 * | 4/2013 | Shibasaki | B65H 45/30 270/32 |
| 8,419,003 | B2 * | 4/2013 | Kojima | B65H 5/062 270/45 |
| 8,465,012 | B2 * | 6/2013 | Ishikawa | B31F 1/08 270/45 |
| 8,651,480 | B2 | 2/2014 | Watanabe et al. | |
| 9,227,807 | B2 | 1/2016 | Watanabe | |
| 2018/0016111 | A1 * | 1/2018 | Watanabe | B65H 43/00 |
| 2018/0056538 | A1 * | 3/2018 | Watanabe | B65H 45/18 |

FOREIGN PATENT DOCUMENTS

JP 2015-124013 A 7/2015

* cited by examiner

*Primary Examiner* — Michael McCullough
(74) *Attorney, Agent, or Firm* — Venable LLP

(57) ABSTRACT

A sheet processing apparatus includes a conveyance unit configured to convey a sheet, a creasing unit configured to form a first crease and a second crease different from the first crease on the sheet, and a detection unit configured to detect a direction of the first crease. When the second crease is to be formed after the formation of the first crease by the creasing unit, a direction of the second crease with respect to a widthwise direction of the sheet is controlled based on a detection result of the detection unit.

10 Claims, 11 Drawing Sheets

SHEET PROCESSING APPARATUS, IMAGE FORMING SYSTEM, AND SHEET PROCESSING METHOD

BACKGROUND OF THE INVENTION

Field of the Invention

The present invention relates to a sheet processing apparatus that can perform a creasing process on a sheet, an image forming system, and a sheet processing method.

Description of the Related Art

Japanese Patent Laid-Open No. 2015-124013 discloses a sheet processing apparatus that detects the leading edge of a conveyed sheet by a skew detection sensor, performs skew correction by an active roller, stops the sheet at a predetermined position, and forms a crease by a creasing mechanism. Crease formation on a sheet is effective in preventing the folded portion of the sheet from cracking when a thick sheet is to be folded. For this type of product, a high folding position accuracy (creasing accuracy) has become required to improve the appearance of the product after it has been folded. Also, in some cases, creasing may be performed for a long sheet such as elongated paper.

Since a sheet is conveyed in a curved state on a curved conveyance path, the sheet may become skewed. Even in such a case, degradation of the creasing process can be prevented by performing the creasing process after correcting the skew by a sheet skew correction arrangement. However, when creasing is to be performed on a plurality of locations on a sheet, even if skewing is avoided in the creasing process for a preceding location, skewing of the sheet may occur in subsequent creasing processes. As a result, the plurality of formed creases may not be parallel to each other, and the accuracy of the creasing process is degraded.

SUMMARY OF THE INVENTION

The present invention provides a sheet processing apparatus that prevents degradation of creasing accuracy due to skewing of a sheet, an image forming system, and a sheet processing method.

The present invention in one aspect provides a sheet processing apparatus comprising: a conveyance unit configured to convey a sheet; a creasing unit configured to form, on the sheet, a first crease and a second crease different from the first crease; a detection unit configured to detect a direction of the first crease; and a control unit configured to control, when forming the second crease after first crease has been formed by the creasing unit, a direction of the second crease with respect to a widthwise direction of the sheet based on a detection result of the detection unit.

Further features of the present invention will become apparent from the following description of exemplary embodiments with reference to the attached drawings.

DESCRIPTION OF THE EMBODIMENTS

Figure 1:
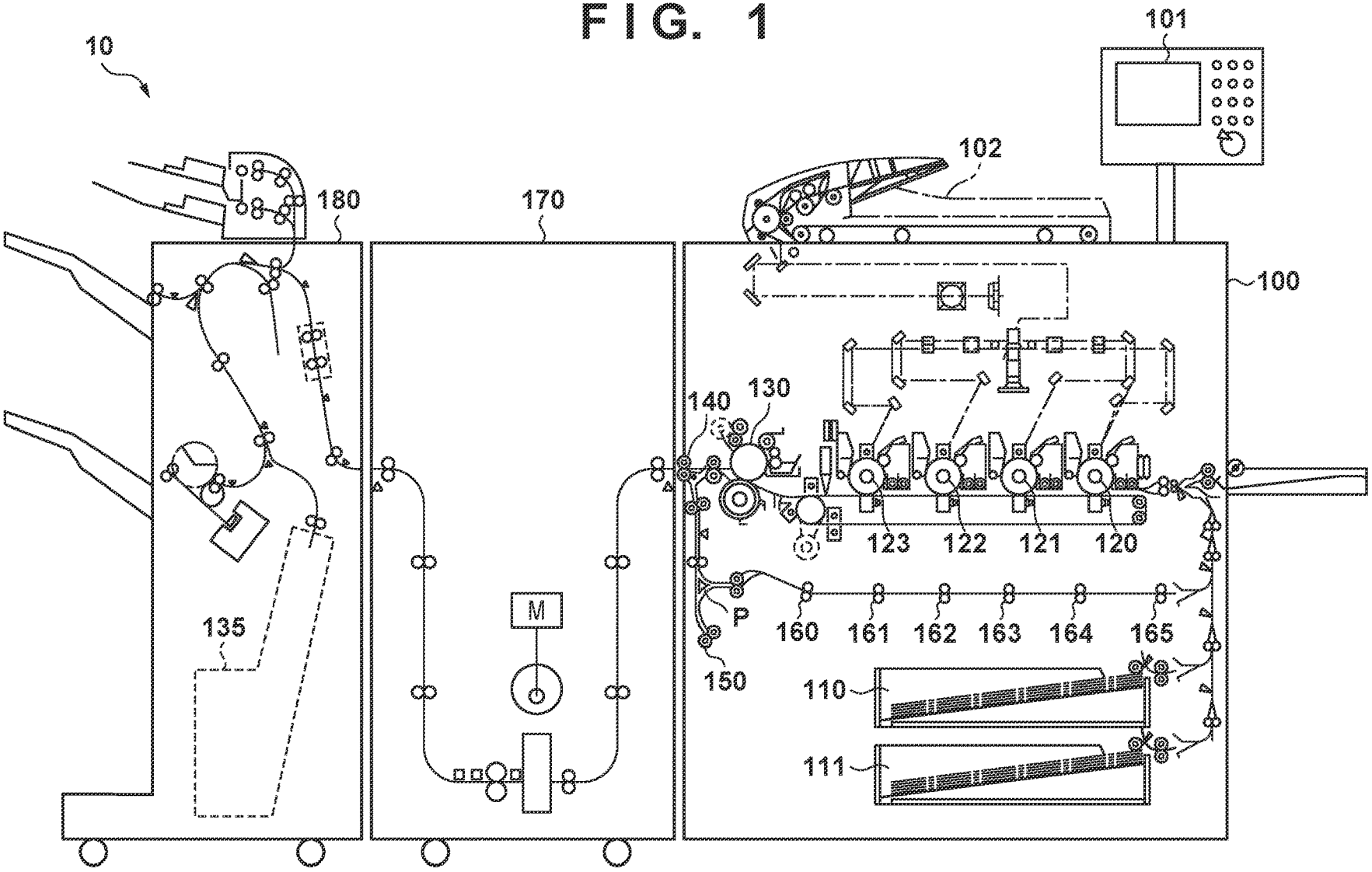
FIG. 1 is a view showing the arrangement of an image forming system.

Preferred embodiments of the present invention will now be described hereinafter in detail, with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention. Note that the same reference numerals denote the same components, and a description thereof will be omitted.

FIG. 1 is a view showing the arrangement of an image forming system 10. As shown in FIG. 1, the image forming system 10 includes an image forming apparatus 100, a creasing apparatus 170, and a finisher 180. The image forming apparatus 100 performs monochrome/color image forming on a print medium such as a sheet or the like. Although the image forming apparatus 100 will be described in this embodiment as having an arrangement in which image forming is performed by an electrophotographic method, it may have an arrangement in which image forming is performed by another printing method such as an inkjet printing method or the like. The creasing apparatus 170 is connected to the image forming apparatus 100 and performs a creasing process on a sheet that has been discharged from the image forming apparatus 100. The finisher 180 is a sheet processing apparatus that performs a finishing process other than the creasing process on the sheet which has been discharged from the creasing apparatus 170. The finisher is, for example, an apparatus that performs a stapling process on the sheet. Note that the image forming apparatus 100 can be used alone without being connected to the finisher 180 and the creasing apparatus 170. The image forming apparatus 100 may have an arrangement that integrally incorporates the creasing apparatus 170 and the finisher 180 as a sheet discharge apparatus. Assume that a position in which a user faces an operation unit 101 to make various kinds of inputs and settings to the image forming apparatus 100 will be referred to as the front side of the image forming apparatus 100 and the back side of the apparatus will be referred to as the rear side. FIG. 1 shows the image forming system 10 when it is seen from the front side of the apparatus. The creasing apparatus 170 and the finisher 180 are sequentially connected to a side (on the post-processing stage side) of the image forming apparatus 100.

A four-color toner image is transferred onto a sheet, which is supplied from cassettes 110 and 111 in the image forming apparatus 100, by photosensitive drums 120, 121, 122, and 123 of yellow, magenta, cyan, and black that form image forming units, respectively. The sheet is conveyed to a fixing unit 130, and the toner image is fixed. If a single-sided image forming mode has been set, the sheet is discharged intact from a discharge roller pair 140 to outside of the apparatus. If a double-sided image forming mode has been set, the sheet is passed from the fixing unit 130 to a reversing roller 150. When the trailing edge of the sheet in the sheet conveyance direction passes a reverse flapper portion P, the reversing roller 150 is rotated in the reverse direction, and the sheet is conveyed toward the direction of double-sided conveyance rollers 160, 161, 162, 163, 164, and 165, which is opposite to the conveyance direction. Subsequently, a four-color toner image is transferred onto the back side of the sheet again by the photosensitive drums 120, 121, 122, and 123. The sheet on which images have been transferred on both sides is transferred again to the fixing unit 130, the toner image is fixed, and the sheet is discharged from the discharge roller pair 140 to outside of the image forming apparatus 100.

Figure 2:
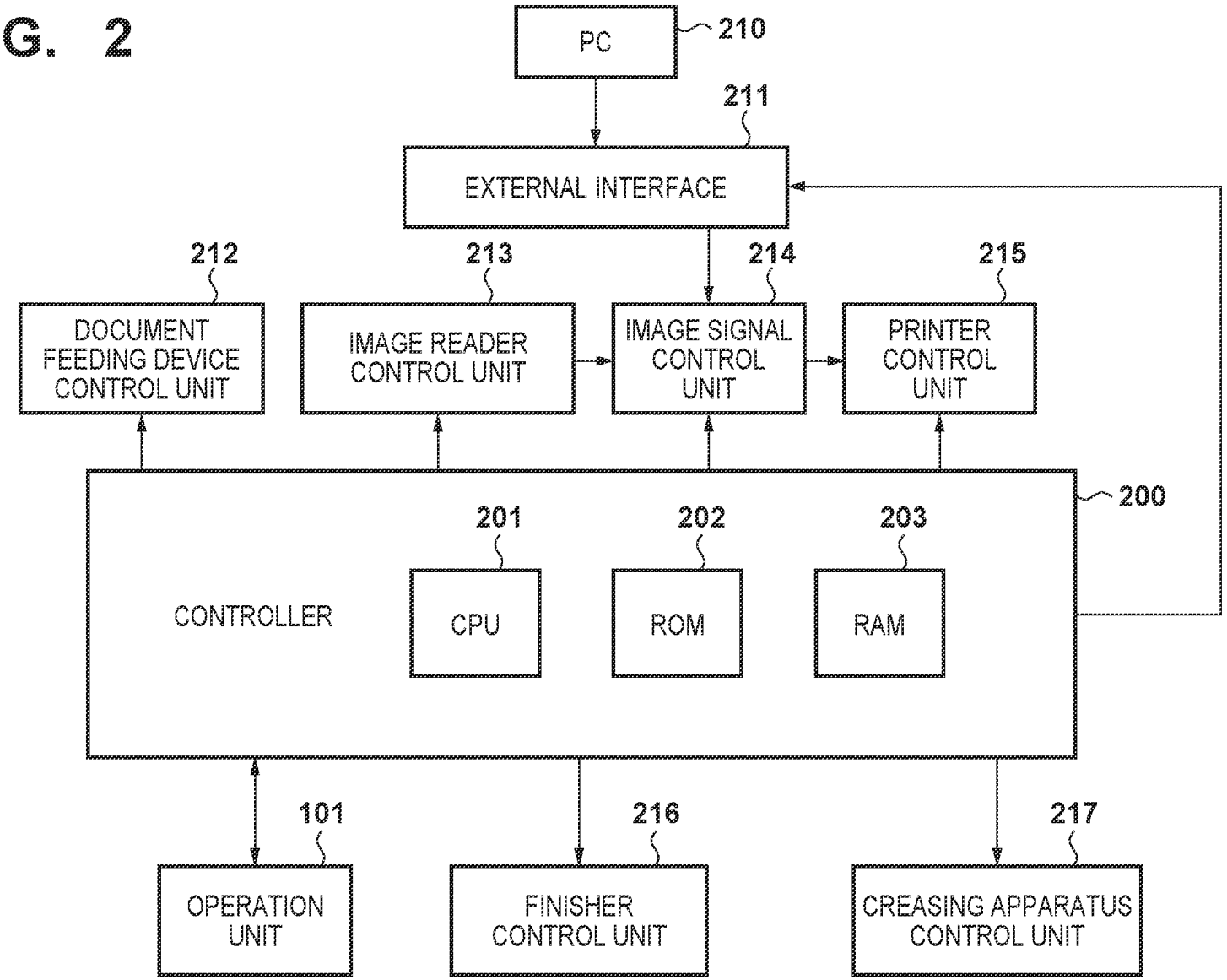
FIG. 2 is a block diagram of the arrangement of a control unit of an image forming apparatus.

FIG. 2 is a block diagram showing the arrangement of a control unit of the image forming apparatus 100. A controller 200 includes a CPU 201, a ROM 202, and a RAM 203. The controller 200 controls a document feeding device control unit 212, an image reader control unit 213, an image signal control unit 214, a printer control unit 215, a finisher control unit 216, a creasing apparatus control unit 217, and an external interface 211. The controller 200 controls the above-described units that are connected to the controller 200 by reading out programs stored in the ROM 202 and executing the programs or based on the settings of the operation unit 101. The document feeding device control unit 212 controls a document feeding device 102 that feeds an original, sheet by sheet, to a reading position of an image reader. The image reader control unit 213 controls the image reader that optically reads an original image. The image reader includes an optical source to irradiate the original with light and an image sensor to detect the reflected light from the original. The printer control unit 215 controls the image forming units that form an image on the sheet. The creasing apparatus control unit 217 controls the creasing apparatus 170. The finisher control unit 216 controls the finisher 180.

This embodiment will describe an arrangement in which the creasing apparatus control unit 217 is incorporated in the creasing apparatus 170 and the finisher control unit 216 is incorporated in the finisher 180. However, the present invention is not limited to this arrangement. For example, it may be arranged so that the creasing apparatus control unit 217 and the finisher control unit 216 are integrally provided in the image forming apparatus 100 together with the controller 200, and the creasing apparatus 170 and the finisher 180 may be controlled from the side of the image forming apparatus 100.

The RAM 203 is used as an area to temporarily hold the control data and as a work area for executing computation associated with control operations. The external interface 211 is an interface from an external PC 210, rasterizes, for example, the print data received from the PC 210 into an image, and outputs the rasterized image to the image signal control unit 214. Image data read by the image sensor of the image reader is output from the image reader control unit 213 to the image signal control unit 214, and the image data output from the image signal control unit 214 to the printer control unit 215 is input to an exposure control unit (not shown). The exposure control unit controls the exposure by the laser that is to irradiate the photosensitive drums.

The creasing apparatus control unit 217 is incorporated in the creasing apparatus 170 and controls the overall driving operation of the creasing apparatus 170 by communicating with the controller 200 of the image forming apparatus 100. The finisher control unit 216 is incorporated in the finisher 180, and controls the overall driving operation of the finisher 180 by communicating with the controller 200 of the image forming apparatus 100. The creasing apparatus control unit 217 and the finisher control unit 216 control the driving of the motors and the sensors included in the creasing apparatus 170 and the finisher 180, respectively.

Figure 3:
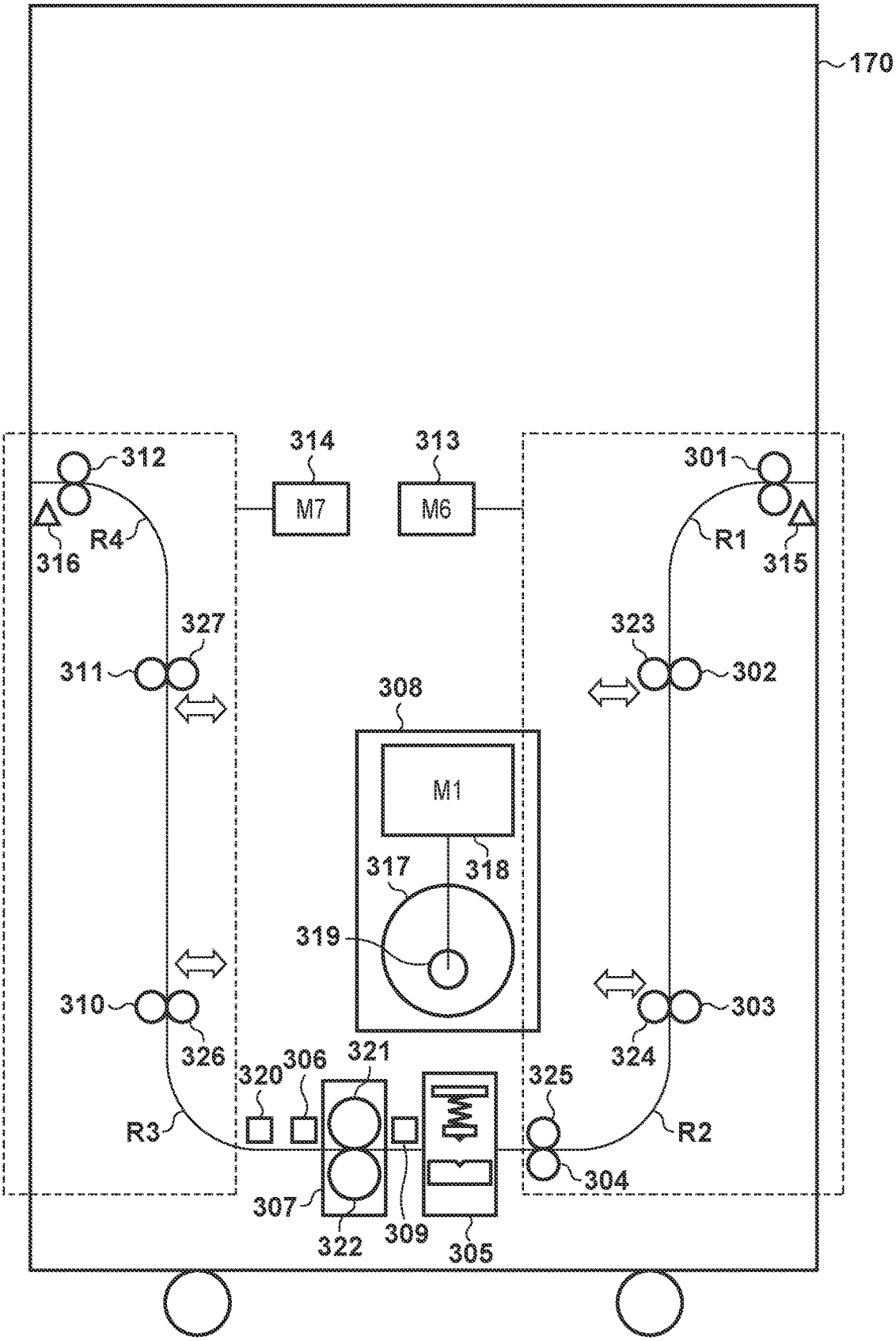
FIG. 3 is a sectional view of a creasing apparatus.

FIG. 3 is a sectional view of the creasing apparatus 170. The creasing apparatus 170 sequentially receives each sheet which has been discharged from the image forming apparatus 100, performs a creasing process on the received sheet, and passes the sheet to the finisher 180 downstream. The process performed on the sheet in the creasing apparatus 170 is operated based on the user settings made on the operation unit 101 which is arranged in the image forming apparatus 100. The user settings are, for example, the creasing position and the number of creases designated by the user.

A sheet that has been discharged from the image forming apparatus 100 is passed to an entrance roller pair 301 of the creasing apparatus 170. The sheet is conveyed to a creasing unit 305 by conveyance roller pairs 302, 303, and 304 and passed through a conveyance path of the creasing unit 305, and the skew amount of the sheet is detected by sheet leading edge skew detection sensors 306 which are arranged along a direction from the front side of the apparatus (corresponding to a front side of the operation unit 101) towards the back of the apparatus. The skew of the sheet is corrected by changing the conveyance amount by a skew correction roller pair 307, which is arranged along the direction from the front side of the apparatus towards the back of the apparatus, in accordance with the skew amount obtained from the detection result. After the sheet has stopped at a predetermined position in the conveyance direction, a creasing drive unit 308 creases the sheet by causing the creasing unit 305 to operate. If a second creasing operation is to be performed, the sheet is conveyed again by the skew correction roller pair 307. The skew amount of the crease is detected when the concave portion of the crease on the sheet is detected by crease skew detection sensors 309 arranged along the direction from the front side of the apparatus towards the back of the apparatus. By changing the conveyance amount of the skew correction roller pair 307 based on the detection result, the skew amount of the sheet is corrected again. The same process such as that of the second creasing operation is performed if third and subsequent creases are to be made.

The creased sheet is conveyed by conveyance roller pairs 310 and 311 and a discharge roller pair 312 and passed to the finisher 180 downstream. More specific detail of the arrangement of each unit will be described later. A conveyance roller driving motor (M6) 313 controls the driving of the entrance roller pair 301, the conveyance roller pairs 302, 303, and 304, and a conveyance roller driving motor (M7) 314 controls the driving of the conveyance roller pairs 310 and 311 and the discharge roller pair 312. Driven rollers 322, 323, 324, 325, 326, and 327 are the driven rollers of the roller pairs, respectively.

Figure 4:
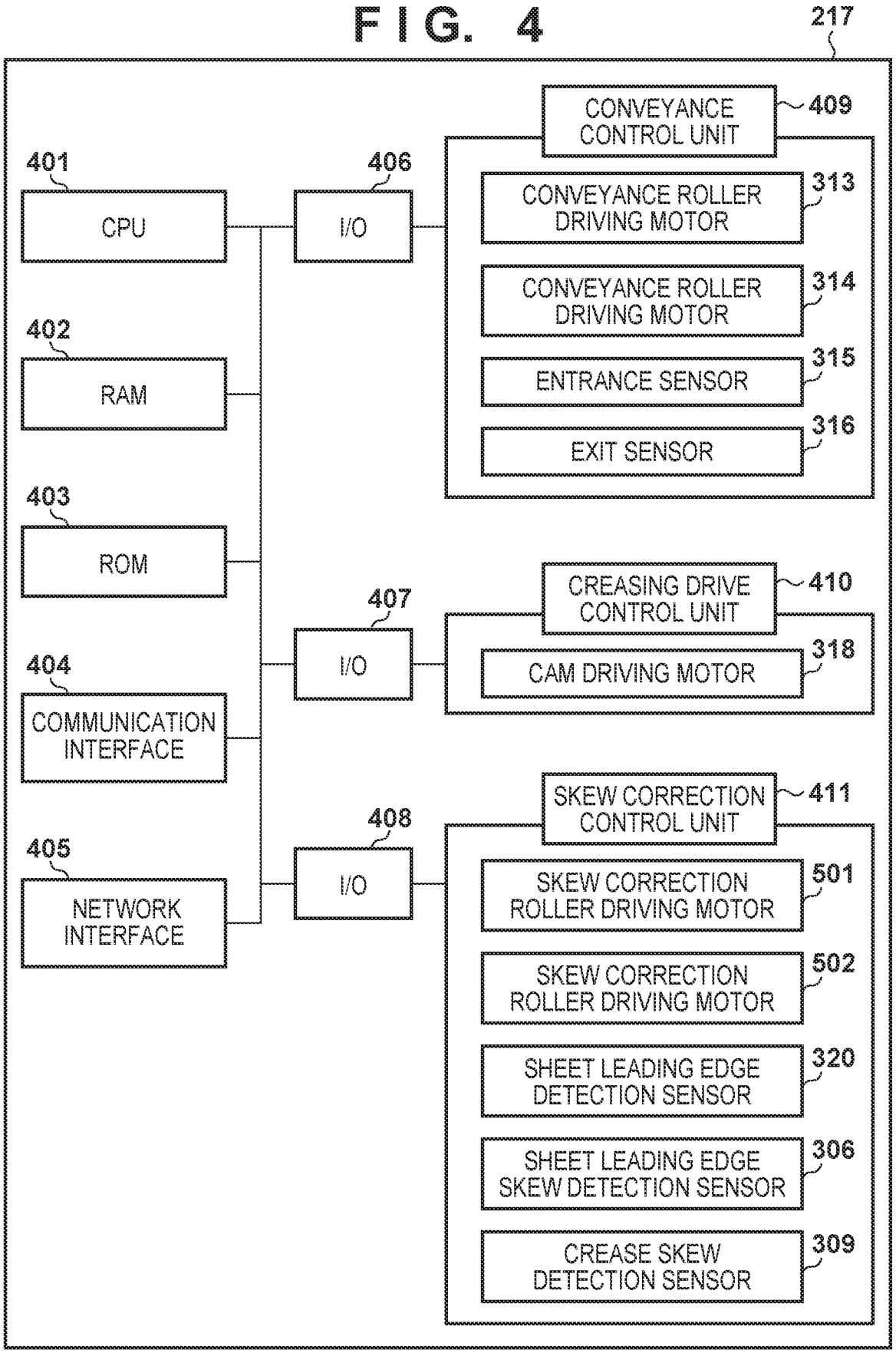
FIG. 4 is a block diagram showing the arrangement of a creasing apparatus control unit.

FIG. 4 is a block diagram showing the arrangement of the creasing apparatus control unit 217. As shown in FIG. 4, the creasing apparatus control unit 217 includes a CPU 401, a RAM 402, a ROM 403, input/output units (I/Os) 406, 407, and 408, a communication interface 404, and a network interface 405. The I/O 406 controls the input to and the output from a conveyance control unit 409. The conveyance control unit 409 controls the sheet conveyance process. The conveyance control unit 409 controls the conveyance roller driving motors 313 and 314 and transmits the detection signals from an entrance sensor 315 and an exit sensor 316 to the I/O 406.

The I/O 407 controls the input to and the output from a creasing drive control unit 410. The creasing drive control unit 410 controls the driving of a cam 317 via a camshaft 319 by a cam driving motor 318. The I/O 408 controls the input to and the output from a skew correction control unit 411. The skew correction control unit 411 transmits, to the I/O 408, the detection signals from a skew correction roller driving motor (M2) 501, a skew correction roller driving motor (M3) 502, a sheet leading edge detection sensor 320, the sheet leading edge skew detection sensors 306, and the crease skew detection sensors 309 shown in FIG. 5. The skew correction control unit 411 controls skew correction driving rollers 321 by the skew correction roller driving motors 501 and 502. Various kinds of sensor signals are input to the input ports of the I/Os 406, 407, and 408. The output ports of the I/Os 406, 407, and 408 are connected to control blocks (not shown) and driving systems which are connected to various types of drivers (not shown).

Figure 6:
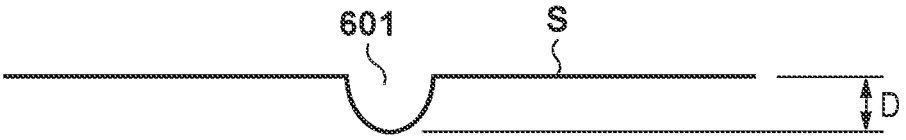
FIG. 6 is a view showing a section of a creased sheet.
Figure 7:
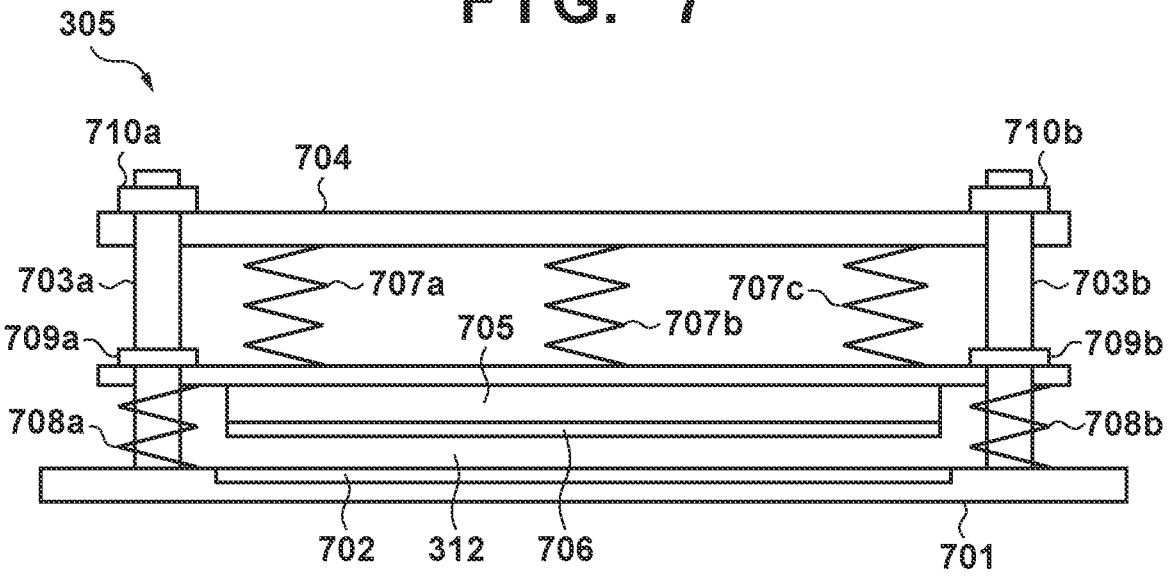
FIG. 7 is a sectional view in which the creasing unit is seen from the downstream side with respect to the sheet conveyance direction.
Figure 8:
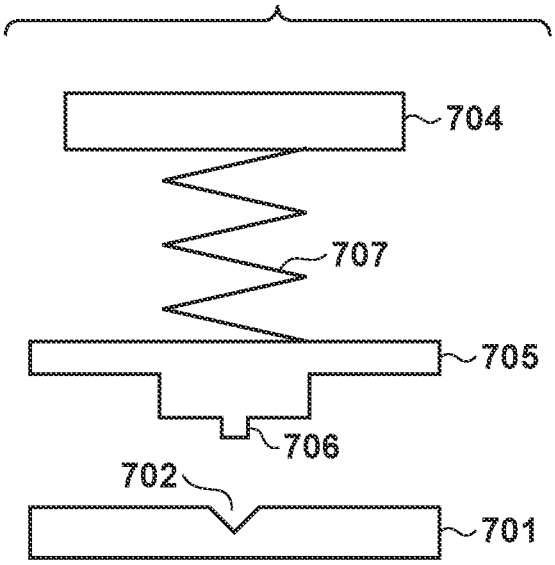
FIG. 8 is a view in which the creasing unit is seen from the front side of the apparatus.

FIG. 7 is a sectional view in which the creasing unit 305 is seen from the downstream side with respect to the sheet conveyance direction, and FIG. 8 is a view in which the creasing unit 305 is seen from the front side of the apparatus. A die plate 701 has a creasing groove 702. Shaft guides 703*a* and 703*b* have been set on the die plate 701 and slidably support a movable plate 704 and a blade plate 705. A creasing blade 706 is set on the blade plate 705 and is arranged so that it can crease a sheet by engaging with the creasing groove 702. The section of a creased sheet has a concave portion 601 such as that shown in FIG. 6.

Figure 9:
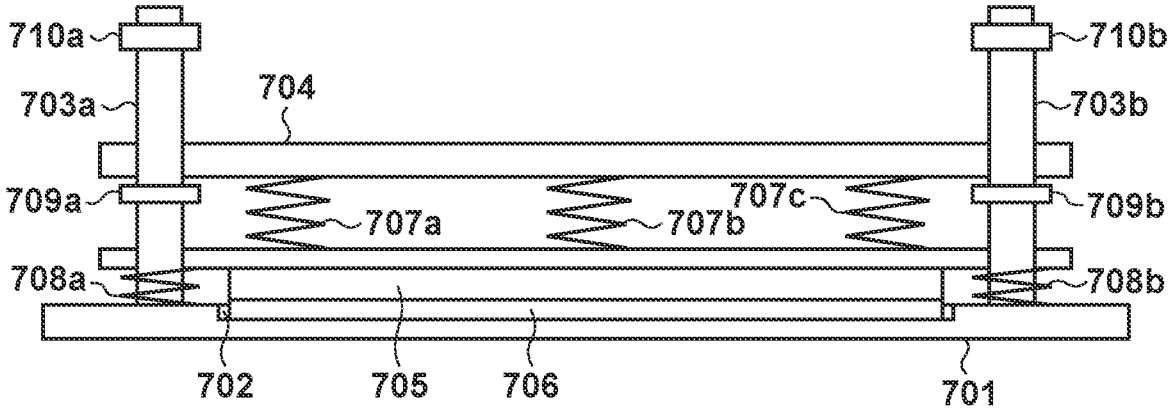
FIG. 9 is a sectional view in which the creasing unit is seen from the downstream side with respect to the sheet conveyance direction.

Pressure springs 707*a*, 707*b*, and 707*c* are arranged between the movable plate 704 and the blade plate 705, and the creasing blade 706 can engage with the creasing groove 702 when the blade plate 705 is pressed downward by the pressure springs 707*a*, 707*b*, and 707*c* by pressing the movable plate 704 downward in the manner shown in FIG. 9 by the cam 317 of FIG. 3. Release springs 708*a* and 708*b* are springs that lift up the pressed blade plate 705, and an upper limit position of a moving range of the blade plate 705 is a position where the blade plate 705 abuts against stoppers 709*a* and 709*b*. The upper limit position of the moving range of the movable plate 704 is a position where the movable plate 704 abuts against stoppers 710*a* and 710*b*. The creasing blade 706 is formed so that pressure is applied equally on the entire area in the sheet widthwise direction when the blade is engaged with the creasing groove 702.

The creasing drive unit 308 in FIG. 3 includes the cam 317 that presses the upper surface of the movable plate 704 of the creasing unit 305 downward, the camshaft 319, and the cam driving motor (M1) 318 that rotates the camshaft 319. The cam 317 is decentered about the axis of the camshaft 319 and is arranged so that the pressed position of the upper surface of the movable plate 704 and the unpressed position of the upper surface of the movable plate are rotatable.

Figure 5:
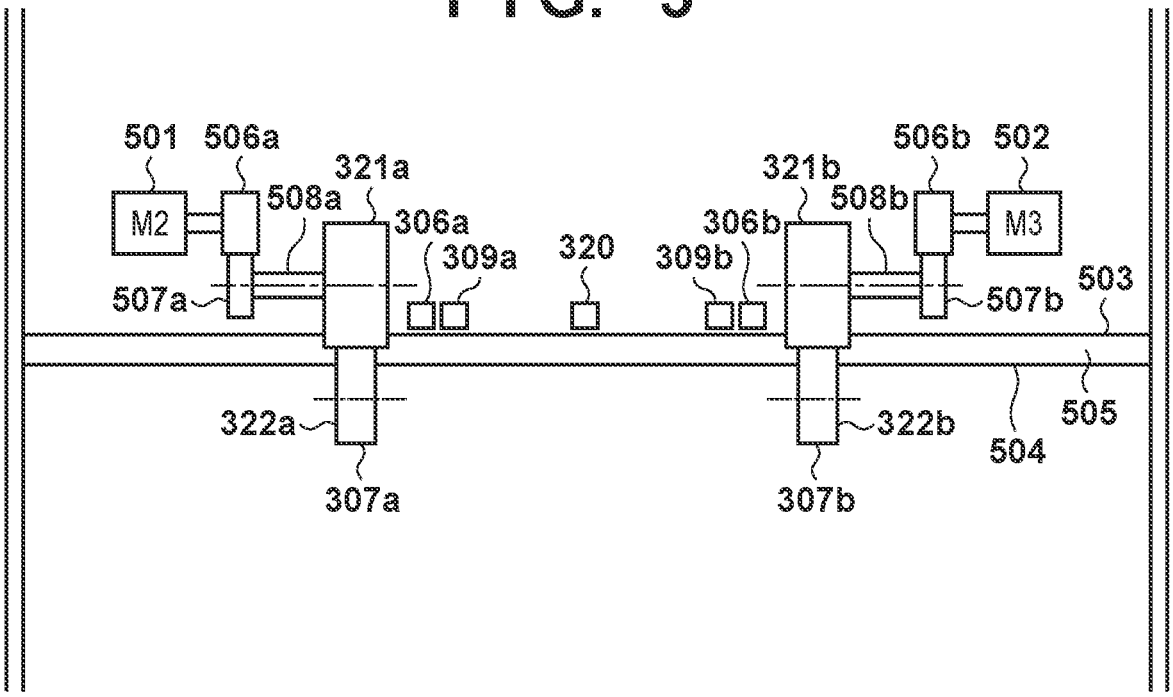
FIG. 5 is a view in which a skew correction unit which includes a creasing unit is seen from the downstream side with respect to a sheet conveyance direction.

Skew correction of a sheet according to this embodiment is performed by a skew correction unit that includes the sheet leading edge detection sensor 320, the sheet leading edge skew detection sensors 306, the crease skew detection sensors 309, and the skew correction roller pair 307 in FIG. 3. The sheet leading edge detection sensor 320 is used to position the sheet to the creasing position from the leading edge of the sheet by detecting the position of the leading edge of the sheet in the conveyance direction and conveying the sheet by a predetermined amount by the skew correction roller pair 307 after detecting the leading edge of the sheet. The sheet leading edge skew detection sensors 306 are formed as sheet skew detection sensors 306*a* and 306*b* as shown in FIG. 5, and used to detect (sheet detection) the leading edge of the conveyed sheet and measure the skew amount of the leading edge of the sheet with respect to the creasing unit 305 from the detection time difference between the two sensors. The creasing unit 305 and the sheet skew detection sensors 306*a* and 306*b* are arranged to be parallel to each other. The sheet skew detection sensors 306*a* and 306*b* are sensors that detect the leading edge of the sheet by projecting light onto the sheet and obtaining the voltage output value of the reflected light.

The crease skew detection sensors 309 are formed as crease skew detection sensors 309*a* and 309*b* as shown in FIG. 5, and are used to detect (crease detection) the groove of the crease formed on the conveyed sheet and measure the skew amount of the crease with respect to the creasing unit 305 from the detection time difference between the two sensors. The creasing unit 305 and the crease skew detection sensors 309*a* and 309*b* are arranged to be parallel to each other. As shown in FIG. 6, the crease skew detection sensors 309*a* and 309*b* are length measuring sensors that measure a distance D (the depth of the groove of the crease) from the paper surface to the bottom of the concave portion. By setting a position at which the measured distance D is largest as the center of the crease in the conveyance direction, the skew amount of the crease is measured based on the time difference between the sensors arranged along the direction from the front side of the apparatus towards the back of the apparatus when the distance D is largest.

FIG. 5 is a view in which the skew correction unit is seen from the downstream side with respect to the sheet conveyance direction. A sheet passing path 505 is formed by upper guide 503 and a lower guide 504, and skew correction driving rollers 321*a* and 321*b* and driven rollers 322*a* and 322*b* that convey the sheet are arranged. The skew correction driving roller 321*a* is driven by the driving motor 501 via gears 506*a* and 507*a* and a roller shaft 508*a*. The correction driving roller 321*b* is driven by the driving motor 502 via gears 506*b* and 507*b* and a roller shaft 508*b*. Skew correction is performed by setting a rotation speed difference between the skew correction driving rollers 321*a* and 321*b* so as to cancel the skew amounts detected by the sheet skew detection sensors 306*a* and 306*b* and the crease skew detection sensors 309*a* and 309*b*.

[Description of Creasing Mode Operation]

The operation of a sheet creasing mode according to this embodiment will be described hereinafter. FIGS. 11A, 11B, 12A and 12B are flowcharts showing a sheet creasing process according to the sheet creasing mode. The processes shown in FIGS. 11A, 11B, 12A and 12B are implemented by, for example, the CPU 401 reading out a program stored in the ROM 403 to the RAM 402 and executing the program. However, the processes of steps S101 to S105 are implemented by the CPU 201 of the image forming apparatus 100 reading out a program stored in the ROM 202 to the RAM 203 and executing the program. Also, all of the processes of FIGS. 11A, 11B, 12A and 12B may be implemented by the CPU 201 of the image forming apparatus 100 reading out a program stored in the ROM 202 to the RAM 203 and executing the program.

In step S101, the operation unit 101 of the image forming apparatus 100 accepts the selection of the creasing mode on the main screen by the user. Upon accepting the selection of the creasing mode, the operation unit 101 displays a creasing mode setting screen. In step S102, the operation unit 101 accepts the selection of the sheet size and the sheet count. The operation unit 101 accepts, in step S103, the input of the crease count, and accepts, in step S104, the input of each crease position. In step S105, the operation unit 101 accepts a copy start instruction. Upon accepting the copy start instruction, printing is started in the image forming apparatus 100.

In step S106, the CPU 401 drives the conveyance roller driving motors 313 and 314 of the creasing apparatus 170 and causes the entrance roller pair 301, the conveyance roller pairs 302, 303, 304, 310, and 311, and the discharge roller pair 312 to rotate.

In step S107, when a sheet is passed from the image forming apparatus 100 to the creasing apparatus 170 and the entrance sensor 315 is set to ON, the CPU 401 causes, in step S108, the skew correction driving rollers 321*a* and 321*b* and the driven rollers 322*a* and 322*b* to rotate by driving the skew correction roller driving motors 501 and 502.

In step S109, when the sheet skew detection sensors 306*a* and 306*b* detect the leading edge of the conveyed sheet, the CPU 401 sets, in step S110, the driven rollers 323, 324, 325, 326, and 327 in a nip released state by turning on a solenoid (not shown). In step S111, the CPU 401 measures the skew amount of the sheet from the detection time difference between the sheet leading edge skew detection sensors 306*a* and 306*b* and obtains the skew amount that is to be corrected by the skew correction driving rollers 321.

By being conveyed in the image forming apparatus 100 and passing through a curved conveyance path R1 in the creasing apparatus 170, the sheet becomes easily skewed by receiving the resistance of the conveyance guide forming the conveyance path. In particular, since a thick paper has high stiffness, it is easily and greatly affected by the resistance of the conveyance guide. When such a skew occurs in this embodiment, correction is performed before the creasing process.

In step S112, the CPU 401 corrects the skew by individually changing the conveyance speeds of the respective skew correction driving rollers 321*a* and 321*b* for a predetermined time by driving the skew correction roller driving motors 501 and 502 so as to cancel the skew. Upon correcting the skew, the CPU 401 changes, in step S113, the conveyance speeds of the respective skew correction driving rollers 321*a* and 321*b* back to the same speed. When the sheet leading edge detection sensor 320 detects the leading edge of the sheet in step S114, the CPU 401 determines, in step S115, whether the sheet has been conveyed to the creasing position by rotating the skew correction driving rollers 321*a* and 321*b* by a predetermined amount based on the distance of the leading edge of the sheet from the creasing unit 305. The CPU repeats the process of step S115 until it is determined that sheet has been conveyed to the creasing position. When it is determined that the sheet has been conveyed to the sheet creasing position, the CPU 401 stops, in step S116, the rotation of the skew correction driving roller 321*a* and 321*b* by the skew correction roller driving motors 501 and 502.

Figure 10A:
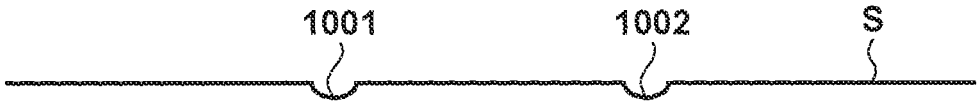
FIGS. 10A, 10B, and 10C are views each showing a sheet that has undergone a creasing process.
Figure 10B:
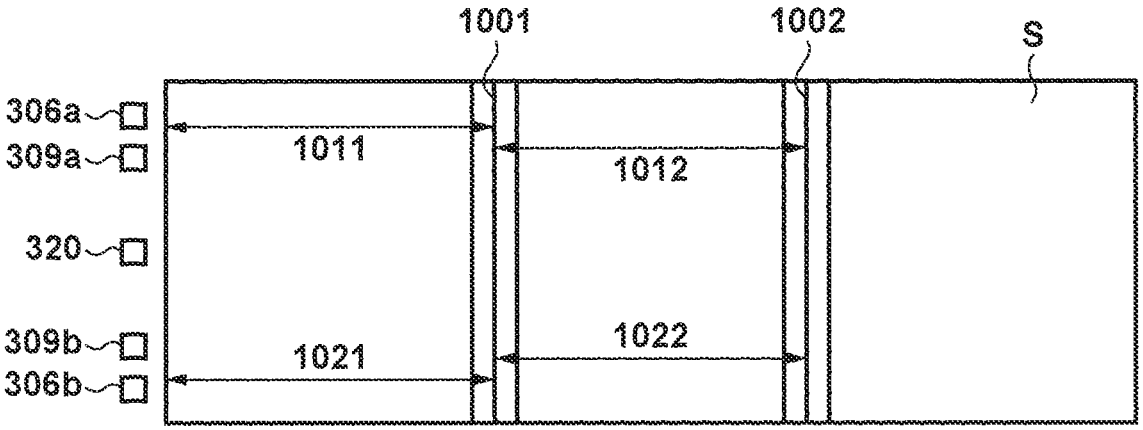

In steps S117 and S118, the CPU 401 performs the creasing process by driving the cam driving motor 318 for one rotation. That is, the CPU 401 turns on the cam driving motor 318 in step S117, and the CPU 401 turns off the cam driving motor 318 in step S118. In step S119, the CPU 401 drives the skew correction roller driving motors 501 and 502 to convey the sheet. At this time, a crease 1001 as shown in FIGS. 10A and 10B has been formed on a sheet S. Hence, in this embodiment, since skew correction is performed in this manner by detecting the skew amount of the sheet before the creasing process, the crease 1001 is not skewed with respect to the leading edge of the sheet, and a length 1011=a length 1021 as shown in FIG. 10B.

In step S120, the CPU 401 determines whether creasing is to be performed in a second location. This determination is performed based on, for example, the setting contents set on the creasing mode setting screen. If it is determined that creasing is to be performed in a second location, the process advances to step S121. Otherwise, the process advances to step S131.

If it is determined that creasing is to be performed in a second location, the crease skew detection sensors 309*a* and 309*b* detect, in step S121, the crease that had been formed on the sheet previously in steps S117 and S118. In step S122, the CPU 401 detects the skew amount of the crease based on the detection time difference between the crease skew detection sensors 309*a* and 309*b* and obtains the skew amount to be corrected by the skew correction driving rollers 321*a* and 321*b* based on the detection result. Note that it may be set not to perform correction by the skew correction driving rollers 321*a* and 321*b* when the skew amount detected in step S122 falls within a predetermined range.

Figure 10C:
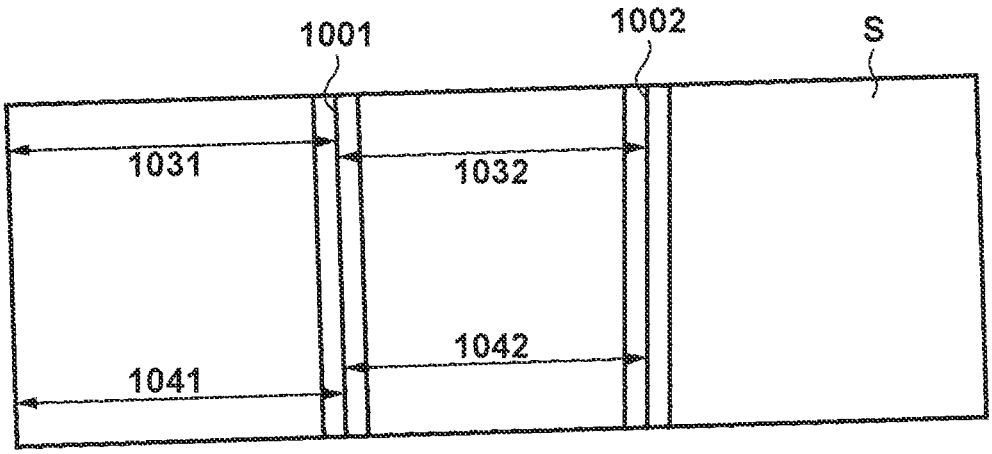
Figure 11A:
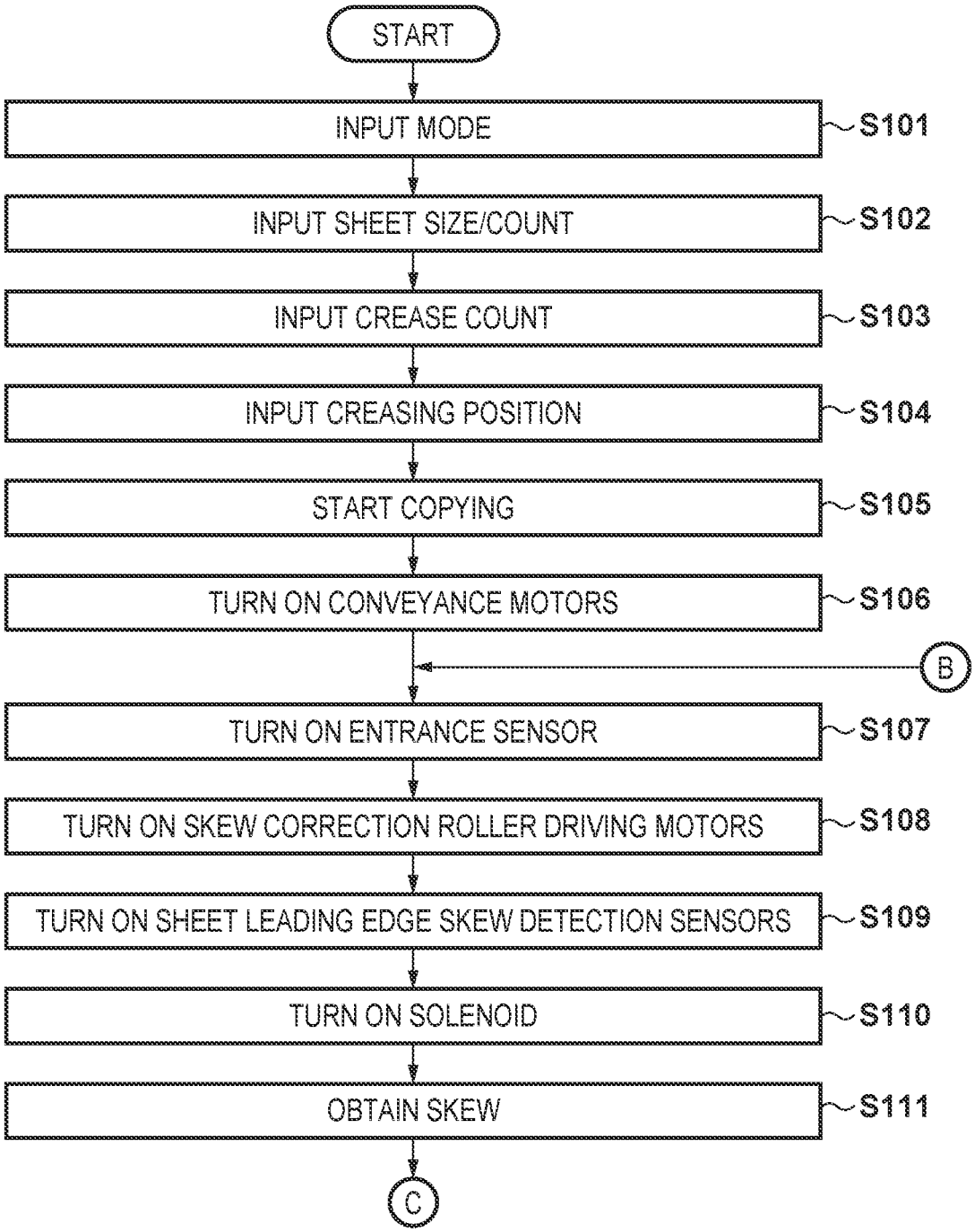
FIGS. 11A and 11B are flowcharts showing a sheet creasing process.
Figure 11B:
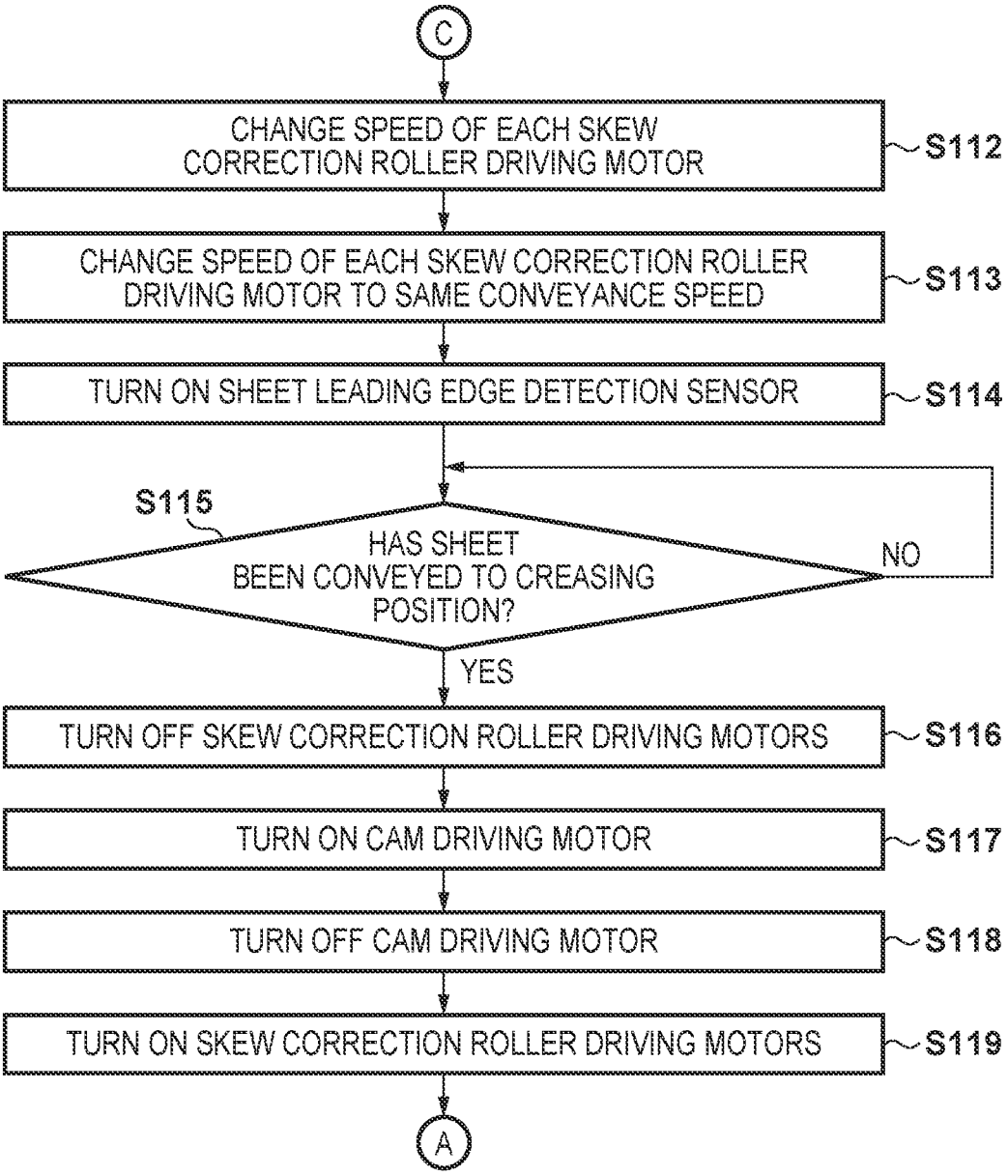
Figure 12A:
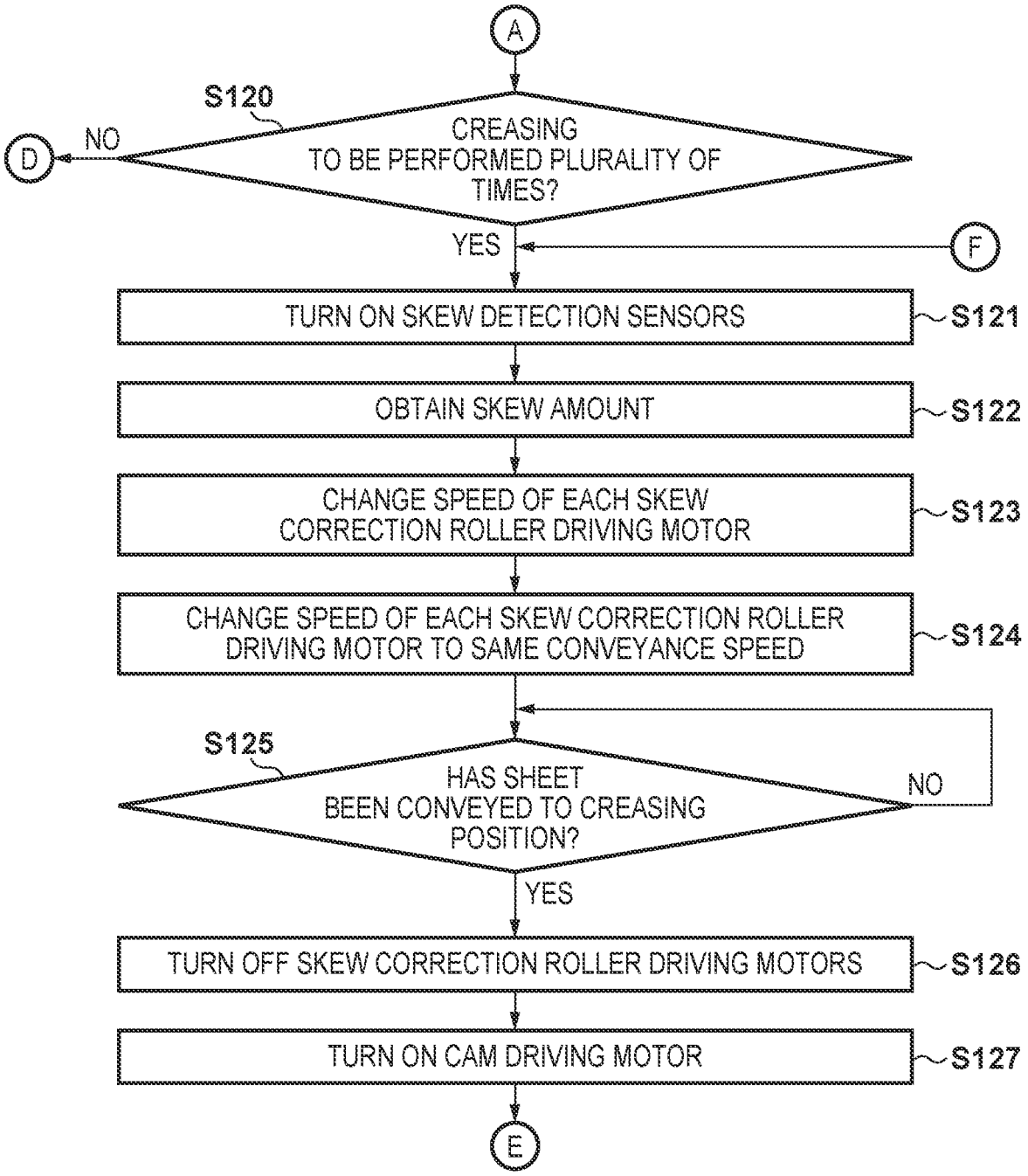
FIGS. 12A and 12B are flowcharts showing the sheet creasing process.
Figure 12B:
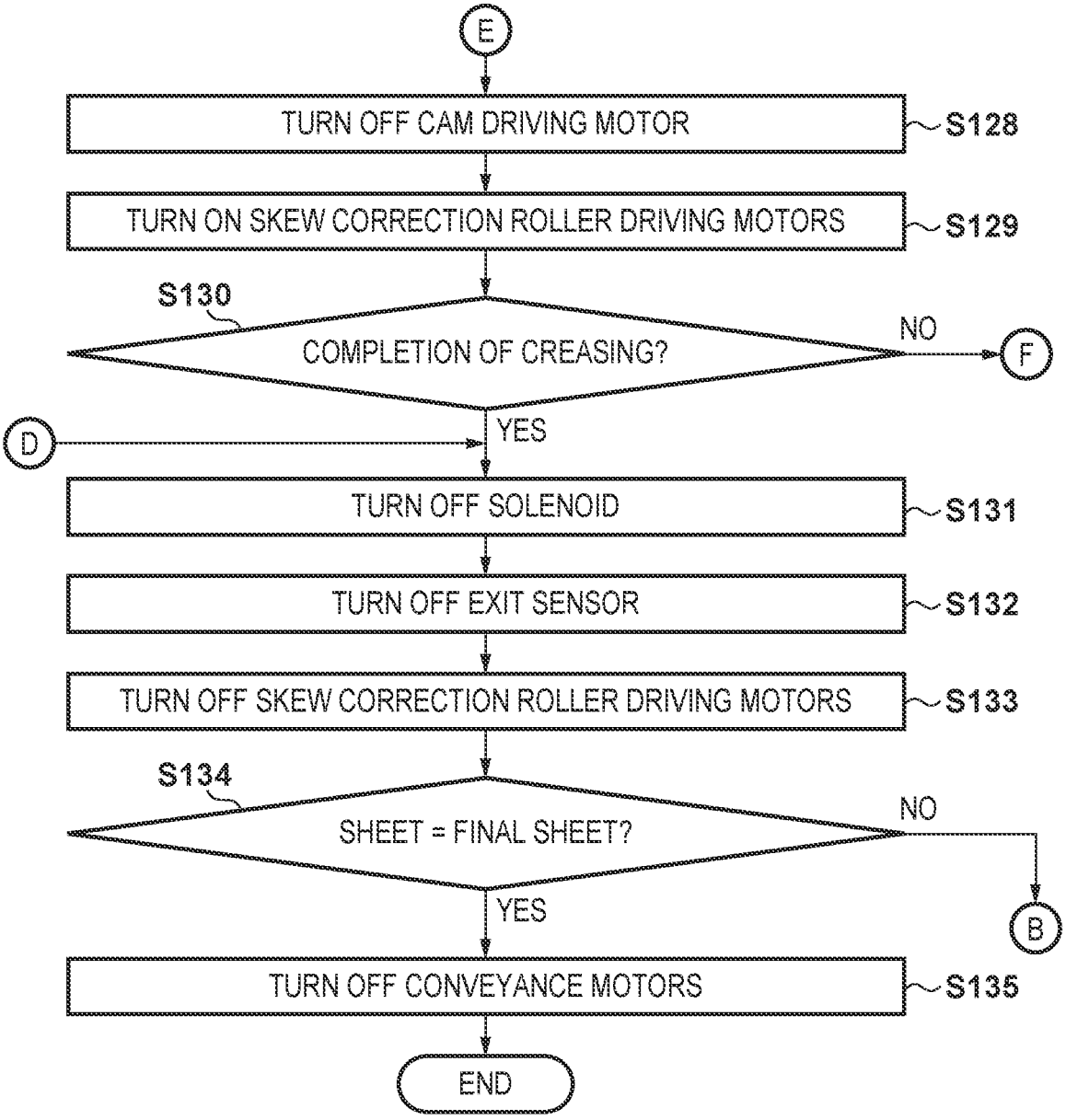

Assume that, even if the sheet has undergone skew correction once, the sheet is conveyed in a state in which the trailing edge of the sheet is on the curved conveyance path R1 and in which the leading edge of the sheet is on a conveyance path R2 in the creasing apparatus 170. In this case, the sheet is skewed upon receiving the resistance of the conveyance guide forming the conveyance path and is conveyed in a skewed state as shown in FIG. 10C. This increases the possibility that the relative positional relationship between the previously formed crease 1001 and a second crease 1002 which is to be formed successively will be skewed. Hence, in this embodiment, in order to prevent the subsequent creasing process from being performed in a state in which the sheet is skewed, skew correction is performed again before the subsequent creasing process in accordance with the skewed state.

In step S123, the CPU 401 performs correction so that the skew will fall within a predetermined range by individually changing the conveyance speeds of the respective the skew correction driving rollers 321*a* and 321*b* for a predetermined time by driving the skew correction roller driving motors 501 and 502 so as to cancel the skew. In step S124, the CPU 401 changes the conveyance speeds of the respective skew correction driving rollers 321*a* and 321*b* by the skew correction roller driving motors 501 and 502 so that the rollers will have the same conveyance speed. In steps S125 and S126, the CPU 401 causes the skew correction driving rollers 321*a* and 321*b* to rotate for predetermined amount and stops the sheet at the creasing position. The CPU 401 performs the creasing process by driving the cam driving motor 318 for one rotation. That is, the CPU 401 turns on the cam driving motor 318 in step S127 and turns off the cam driving motor 318 in step S128. Subsequently, in step S129, the CPU 401 conveys the sheet by driving the skew correction roller driving motors 501 and 502. At this time, the crease 1002, as shown in FIGS. 10A and 10B, can be formed on the sheet S.

Note that in this embodiment, the respective positions of the creasing unit 305 and the crease skew detection sensors 309*a* and 309*b* have been arranged so as not to sandwich a curved portion in the conveyance path. This is because if the detection of the skew of a crease is performed in a position sandwiching a curved portion after the creasing process, it may not be possible to correctly detect the generated skew depending on the degree of the warp of the sheet S in the curved portion. By arranging the creasing unit 305 and the crease skew detection sensors 309*a* and 309*b* in the manner according to this embodiment, it is possible to detect a skew that has occurred to the sheet S by the conveyance performed after the creasing process.

Hence, in this embodiment, since the crease 1002 is formed after detecting the skew amount of the crease 1001 before the creasing process and correcting the detected skew, the crease 1002 is not skewed with respect to the crease 1001, and a length 1012=a length 1022. That is, the crease 1001 and the crease 1002 can be set to fall within a predetermined skew range, and thus the parallelism can be improved. If a creasing process is performed without performing this skew correction, the crease 1002 becomes skewed with respect to the crease 1001 as shown in FIG. 10C, and a length 1032≠a length 1042.

In step S130, the CPU 401 determines whether the creasing process has been completed. If it is determined that the creasing process has not been completed, that is, if the creasing process is to be performed further in a different location on the same sheet, processes are repeated from step S121. Otherwise, the process advances to step S131.

In step S131, the CPU 401 sets the driven rollers 323, 324, 325, 326, and 327 in a nipped state by turning off the solenoid (not shown). The CPU 401 passes the sheet from the creasing apparatus 170 to the finisher 180. When the exit sensor 316 detects, in step S132, the completion of sheet discharge to the outside of the creasing apparatus 170, the CPU 401 stops, in step S133, the driving of the skew correction driving rollers 321*a* and 321*b* by the skew correction roller driving motors 501 and 502.

In step S134, the CPU 401 determines whether the sheet is the final sheet that is to be a creasing process target. If the sheet is determined not to be the final sheet, processes are repeated from step S107. On the other hand, if the sheet is determined to be the final sheet, the CPU 401 completes the job by stopping the conveyance roller driving motors 313 and 314 to stop the conveyance roller pairs. Subsequently, the process of FIGS. 11A and 11B and FIGS. 12A and 12B ends.

Other Embodiments

Although the sheet leading edge skew detection sensors 306 and the crease skew detection sensors 309 are arranged as separate components in this embodiment, the sheet leading edge skew detection sensors 306 may be arranged to serve also as the crease skew detection sensors as distance measuring sensors. Since this arrangement can shorten the sheet conveyance distance from the location of skew detection and skew correction of the first crease until the location of the creasing process of the second crease, the parallelism of the first crease and the second crease can be improved. In addition, the sheet leading edge detection sensor 320 may be capable of performing detection even after the passage of the crease, and the creasing process in the second location may be performed by conveying the sheet for a predetermined distance after the sheet leading edge detection sensor 320 has detected the passage of the first crease. This arrangement can improve the accuracy of the distance from the first crease to the second crease.

Also, in place of the plurality of sensors arranged along the direction from the front side of the apparatus towards the back of the apparatus in the sheet widthwise direction (a direction intersecting with (perpendicular to) the conveyance direction), that is, the sheet skew detection sensors 306*a* and 306*b* and the crease skew detection sensors 309*a* and 309*b*, a line sensor may be used or the user may scan the sheet, which underwent the creasing process, by a scanning apparatus and correct the skew.

As described above, according to this embodiment, the parallelism between creases formed on a sheet can be improved. Although this embodiment has an arrangement that detects the skew of the first crease, corrects the sheet in accordance with the detected skew, and subsequently performs the next creasing process in the second location, the present invention is not limited to this arrangement. For example, even in a case in which the creasing process in the second location is not to be performed, it may be arranged so that the skew of the sheet will be corrected in accordance with the skew of the first crease. This arrangement allows the sheet to be conveyed in a state with fewer occurrences of skewing.

In addition, the above-described embodiment has an arrangement in which the sheet position is changed (the sheet is corrected) by detecting the skew of the first crease and performing correction in accordance with the detected skew. However, it is not limited to the arrangement in which the sheet position is changed to perform the creasing process in a second location, and another arrangement may be used. For example, it may be arranged so that the direction of the creasing unit 305 is changed, and the creasing process may be performed so that the skew with respect to first crease will fall within a predetermined range. In this case, for example, a turntable arrangement may be set in the bottom of the creasing unit 305 to provide an arrangement in which the creasing unit 305 can be rotated about a shaft. When the skew of the first crease is detected, the creasing unit 305 can be rotated in accordance with the detection value (for example, angle with respect to the conveyance direction).

Furthermore, it may have an arrangement combining the rotation of the skew correction rollers and the creasing unit 305.

As described above, according to this embodiment, it is possible to prevent the degradation of creasing accuracy caused by skewing of the sheet.

Embodiment(s) of the present invention can also be realized by a computer of a system or apparatus that reads out and executes computer executable instructions (e.g., one or more programs) recorded on a storage medium (which may also be referred to more fully as anon-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-118765, filed Jun. 16, 2017, and Japanese Patent Application No. 2018-089823, filed May 8, 2018, which are hereby incorporated by reference herein in their entirety.

What is claimed is:

1. A sheet processing apparatus comprising:

a conveyance unit configured to convey a sheet in a conveyance direction, the conveyance unit being able to correct skew of the sheet;

a creasing unit configured to form, on the sheet, a first crease and a second crease different from the first crease;

a detection unit configured to detect a direction of the first crease; and a control unit configured to control the conveyance unit to correct skew of the sheet on which the first crease is formed by the creasing unit based on a detection result of the detection unit, and configured to control the creasing unit to form the second crease on the sheet of which the skew is corrected by the conveyance unit.

2. The apparatus according to according to claim 1, further comprising:

a leading edge detection unit configured to detect a skew of the leading edge of the sheet in the conveyance direction, wherein the control unit controls the conveyance unit to correct the direction of the first crease with respect to a widthwise direction of the sheet based on a detection result of the leading edge detection unit, the widthwise direction intersecting the conveyance direction.

3. The apparatus according to claim 2, wherein the leading edge detection unit includes a plurality of sheet detection units which are arranged in the widthwise direction, and the leading edge detection unit detects the skew of the leading edge of the sheet in the conveyance direction based on detection results from the plurality of sheet detection units.

4. The apparatus according to claim 1, wherein the conveyance unit includes a plurality of rollers arranged in a widthwise direction perpendicular to the conveyance direction of the sheet, and the control unit controls the direction of the second crease with respect to the widthwise direction of the sheet by controlling a conveyance speed of each of the plurality of rollers.

5. The apparatus according to claim 1, wherein the detection unit is a line sensor.

6. The apparatus according to claim 1, wherein the detection unit includes a plurality of crease detection units arranged in a plurality of locations on a widthwise direction perpendicular to the conveyance direction of the sheet.

7. The apparatus according to claim 1, wherein the sheet to be conveyed to the creasing unit is supplied from an image forming apparatus configured to form an image on the sheet.

8. An image forming system comprising:

an image forming apparatus configured to form an image on a sheet; and a sheet processing apparatus defined in claim 1.

9. A sheet processing method which is executed by an image forming apparatus, the method comprising:

conveying a sheet by a conveyance unit;

forming a first crease on the sheet with a creasing unit;

detecting a direction of the first crease;

correcting, with the conveyance unit, skew of the sheet on which the first crease is formed by the creasing unit based on a result of the detecting; and forming a second crease different from the first crease by the creasing unit on the sheet of which the skew is corrected by the conveyance unit.

10. A sheet processing apparatus comprising:

a conveyance unit configured to convey a sheet in a conveyance direction;

a creasing unit configured to form, on the sheet, a first crease and a second crease different from the first crease;

a detection unit configured to detect a direction of the first crease;

a changing unit configured to be able to change a direction of the creasing unit with respect to the conveyance direction; and a control unit configured to control the changing unit to change the direction of the creasing unit, and control the creasing unit to form the second crease on the sheet on which the first crease is formed by the creasing unit after the direction of the creasing unit is changed based on a detection result of the detection unit.

* * * * *